US007690947B2

(12) United States Patent
Gu et al.

(10) Patent No.: US 7,690,947 B2
(45) Date of Patent: Apr. 6, 2010

(54) ELECTRICAL CONNECTOR WITH IMPROVED GROUNDING STRUCTURE

(75) Inventors: Hao Gu, Kunshan (CN); Qi-Sheng Zheng, Kunshan (CN); Zhi-Quan Mou, Kunshan (CN); Jie Cai, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/156,058

(22) Filed: May 28, 2008

(65) Prior Publication Data

US 2008/0299828 A1 Dec. 4, 2008

(51) Int. Cl.
*H01R 13/648* (2006.01)

(52) U.S. Cl. ..... 439/607.23

(58) Field of Classification Search ..... 439/607.23–607.28, 607.34–607.35, 939, 439/607.01

See application file for complete search history.

(56) References Cited

U.S. PATENT DOCUMENTS 6,238,244 B1 * 5/2001 Yang ..... 439/607.01
2007/0077816 A1 * 4/2007 Wan et al. ..... 439/607

* cited by examiner

*Primary Examiner*—Phuong K Dinh
(74) *Attorney, Agent, or Firm*—Wei Te Chung; Andrew C. Cheng; Ming Chieh Chang

(57) ABSTRACT

An electrical connector (100) for mating with a corresponding plug (200) includes a dielectric housing (1) defining two contact areas (15) along an up to down direction. An outer shield (3) encloses the dielectric housing. A plurality of contacts (2) are retained in the contact areas. An inner shield (4) are mounted between two contact areas and comprises a pair of spring arms (42) extending into the contact area to lock with the plug and a resilient strip (43) extending into the contact areas to abutting against an outer side of the plug.

3 Claims, 5 Drawing Sheets

ELECTRICAL CONNECTOR WITH IMPROVED GROUNDING STRUCTURE

BACKGROUND OF THE INVENTION

1. Field of the Invention

The present invention relates to electrical connectors, and more particularly to electrical connectors with improved grounding structure.

2. Description of Related Art

Electrical connectors are widely used in various peripherals for electrically connecting with each other. With a miniature development of the electrical device, the electrical connector is tended to be designed with a miniature structure for reducing occupied area. Usually, electrical connectors are stacked with each other for obtaining the purpose. Such electrical connector usually includes an insulative housing, a plurality of contacts retained in the insulative housing and an outer shield enclosing the insulative housing. The insulative housing comprises two or more mating sections stacked with each other along an up to down direction for mating with a corresponding plug. A partition plate extends forwardly from the insulative housing and is located between two mating sections. The electrical connector also includes an inner shield enclosing the partition plate. The inner shield includes two pairs of spring arms extending into two mating sections respectively.

The outer shield is stamped from a unitary one-piece metal sheet to have a generally rectangular configuration with four peripheral walls including a pair of top wall and bottom wall, and a pair of side walls. Each of the top wall, bottom wall and side walls has a pair of spring arms extending into the mating sections. Usually, the corresponding plug includes an insulative housing with a number of mating contacts retained thereon, and a metal shield enclosing the insulative housing. The metal shield defines a plurality of openings locking with the spring arms of the inner shield, the upper and lower walls of the outer shield. In addition, the spring arms of the side walls abut against the metal shield of the plug for grounding.

However, the outer shield is made of ordinary, low cost material, such as iron, for reducing the cost of the electrical connector usually. But the ordinary, low cost material has badly mechanical property that could not ensure desirably flexibility of the spring arms, and would adversely affect the contact between the spring arms and the plug after longtime mating cycles. The grounding performance tends to be worse at the same time. If the outer shield is made of material with excellent mechanical property, the cost of the electrical connector will be increased.

Hence, an electrical connector with improved grounding performance and low cost is needed to solve the problem above.

BRIEF SUMMARY OF THE INVENTION

According to one aspect of the present invention, an electrical connector for mating with a corresponding plug includes a dielectric housing defining two contact areas along an up to down direction. An outer shield encloses the dielectric housing. A plurality of contacts are retained in the contact areas. An inner shield are mounted between two contact areas and comprises a pair of spring arms extending into the contact area to lock with the plug and a resilient strip extending into the contact areas to abutting against an outer side of the plug.

According to another aspect of the present invention, an electrical connector comprises a dielectric housing. The dielectric housing has a partition plate to divide the dielectric housing into an upper portion and a lower portion. An outer shield encloses the dielectric housing to form two contact areas with the partition plate. A plurality of contacts are retained in the dielectric housing. Each contact comprises a contact portion extending into the contact area. An inner shield encloses the partition plate. The inner shield has an upper wall and a lower wall located at the upper and lower sides of the partition plate. Each of the upper and lower walls has a pair of spring arms extending into the contact area and a resilient strip extending into the contact area for abutting against a corresponding plug. The resilient strip extends along a direction opposite to the spring arm.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
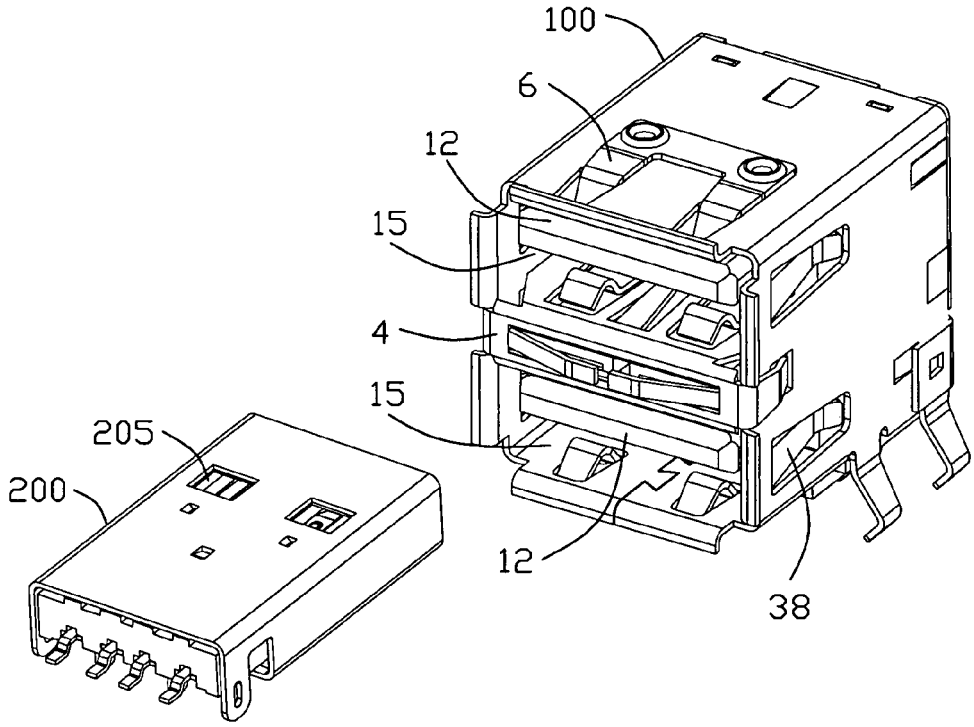
FIG. 1 is a perspective view of the preferred embodiment of an electrical connector and a corresponding plug according to the present invention.
Figure 2:
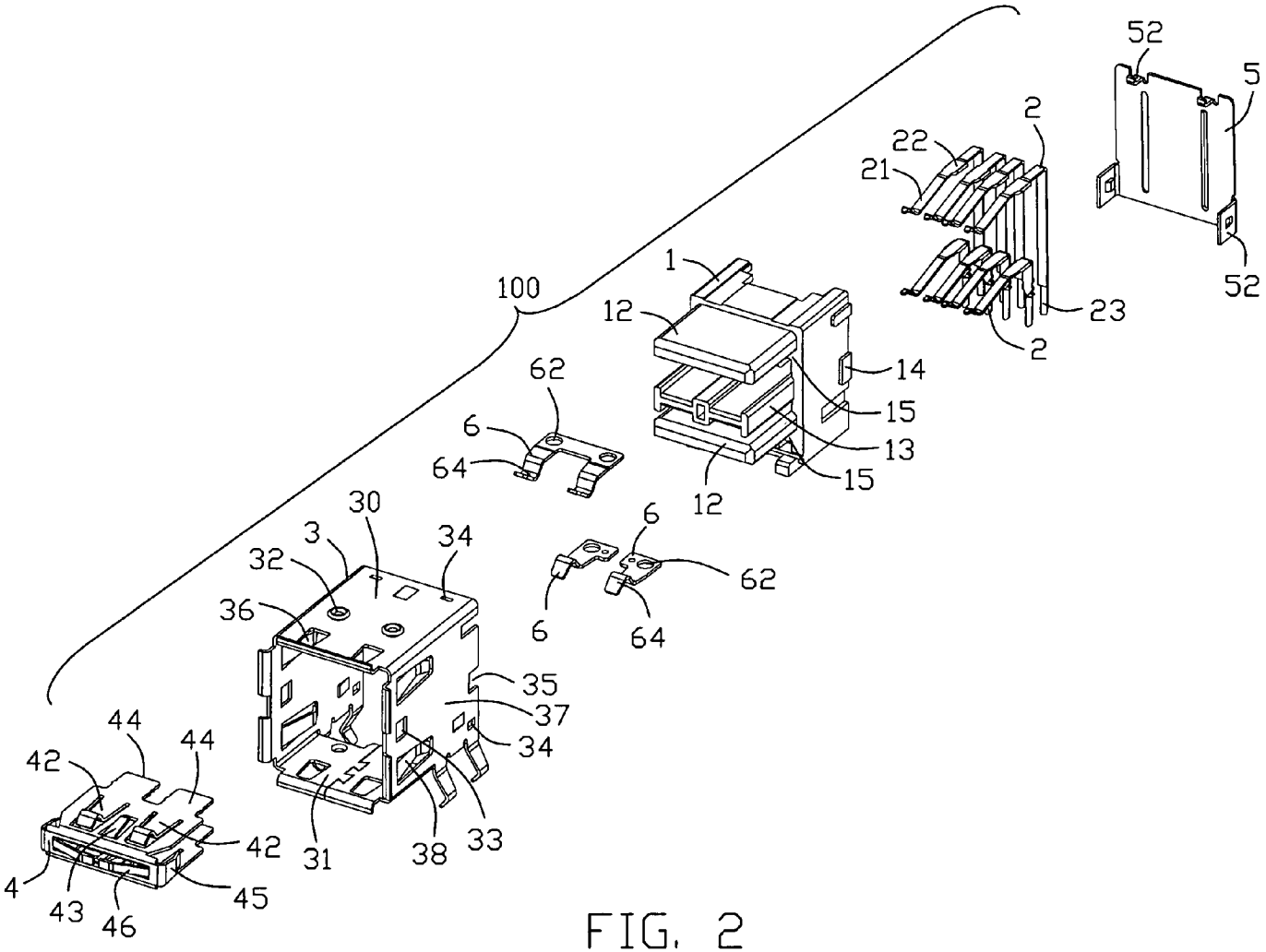
FIG. 2 is an exploded perspective view of the electrical connector shown in FIG. 1.
Figure 3:
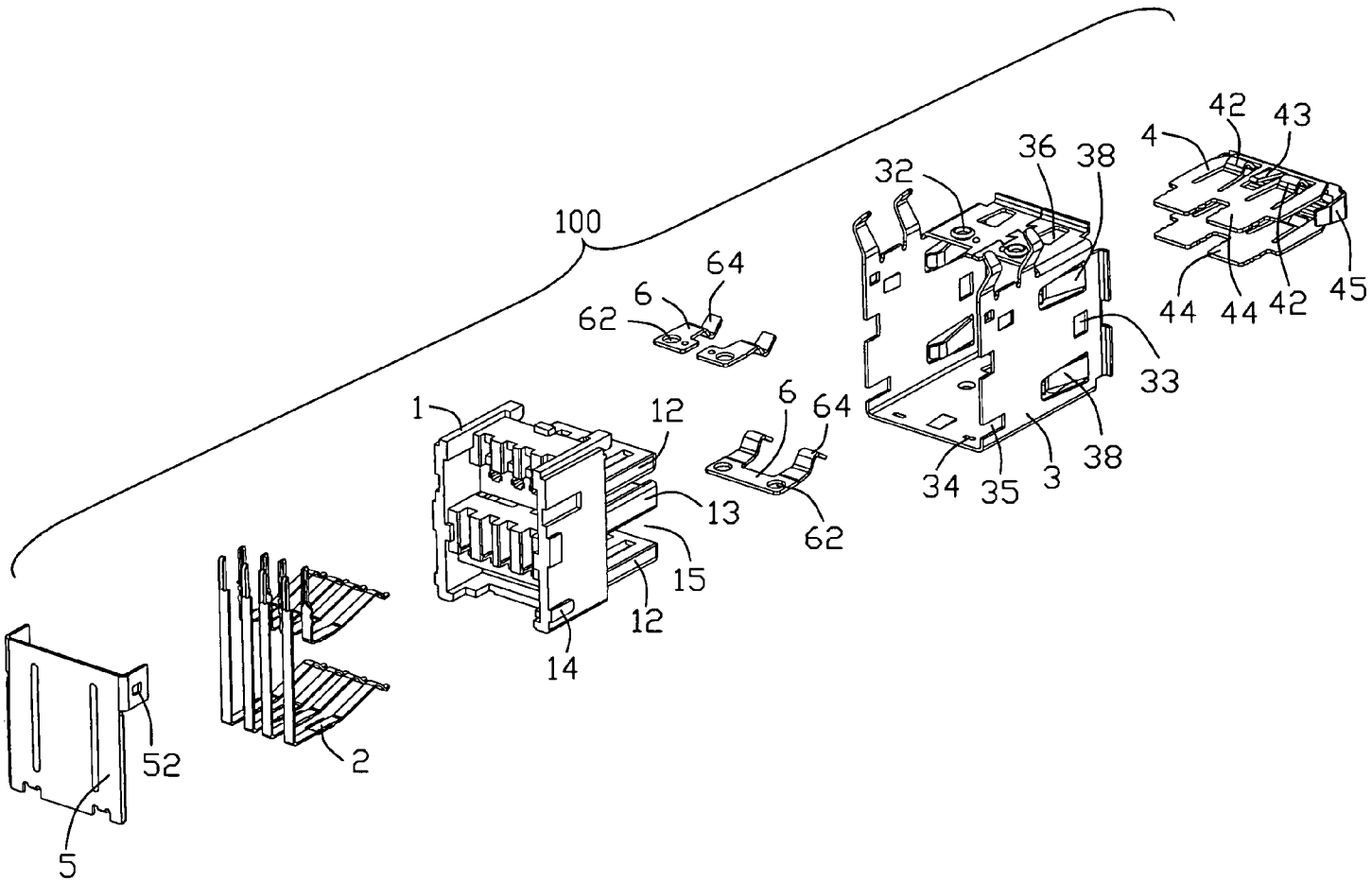
FIG. 3 is a view similar to FIG. 2, while taken from another aspect.

Referring to FIGS. 1-3, an electrical connector 100 for mating with a corresponding plug 200 is disclosed in accordance with the present invention. The electrical connector 100 comprises a dielectric housing 1, a plurality of contacts 2 retained in the dielectric housing 1, an outer shield 3 enclosing the dielectric housing 1, an inner shield 4 mounted on the dielectric housing 1, a rear shield 5 covering a rear side of the dielectric housing 1 and a plurality of resilient fingers 6 retained on the outer shield 3.

Referring to FIGS. 2 and 3, the dielectric housing 1 is made of dielectric material, and has a partition plate 13 extending forwardly, flatly therefrom to divide the dielectric housing 1 into an upper portion and a lower portion. The outer shield 3 encloses the dielectric housing 1 to form an upper and a lower contact areas 15 therebetween to receiving the corresponding plug 200. Each contact area 15 comprises a tongue plate 12 extending forwardly form the dielectric housing 1 and being parallel to the partition plate 13. The dielectric housing 1 has a plurality of protrusions 14 located at two sides thereof.

Each contact 2 has a securing portion 22 engaging with the dielectric housing 1, a contact portion 21 extending forwardly into the contact area 15 from the securing portion 22, and a tail portion 23 extending downwardly from the securing portion 22.

The outer shield 3 is made of common iron sheet, and is stamped from a unitary one-piece metal sheet to have a generally rectangular configuration with four peripheral walls including a pair of top wall 30 and bottom wall 31, and a pair of side walls 37. Each of the top wall 30 and the bottom wall 31 comprises a pair of projections 32 extending outwardly, and a pair of openings 36 located at the front of the projections 32. Each side wall 37 has a pair of engaging arms 38 extending into the contact area 15 respectively. A locking hole 33 is formed between the pair of engaging arms 38. Each side wall 37 also defines a plurality of apertures 35 engaging with the protrusions 14 of the dielectric housing 1. A plurality of fastening holes 34 are formed in the top wall 30 and side walls 37 for engaging with the rear shield 5.

Each resilient finger 6 is made of material with excellent mechanical property, and comprises a mounting hole 62 engaging with the projection 32 of the outer shield 3, and a locking portion 64 having desirable flexibility and protruding into the contact area 15 through the opening 36 of the outer shield 3. There are two resilient fingers 6 assembled on the top wall 30, and two resilient fingers 6 assembled on the bottom wall 31. The resilient fingers 6 assembled on the top wall 30 are connected with each other. While the resilient fingers 6 assembled on the bottom wall 31 are separated with each other.

Figure 4:
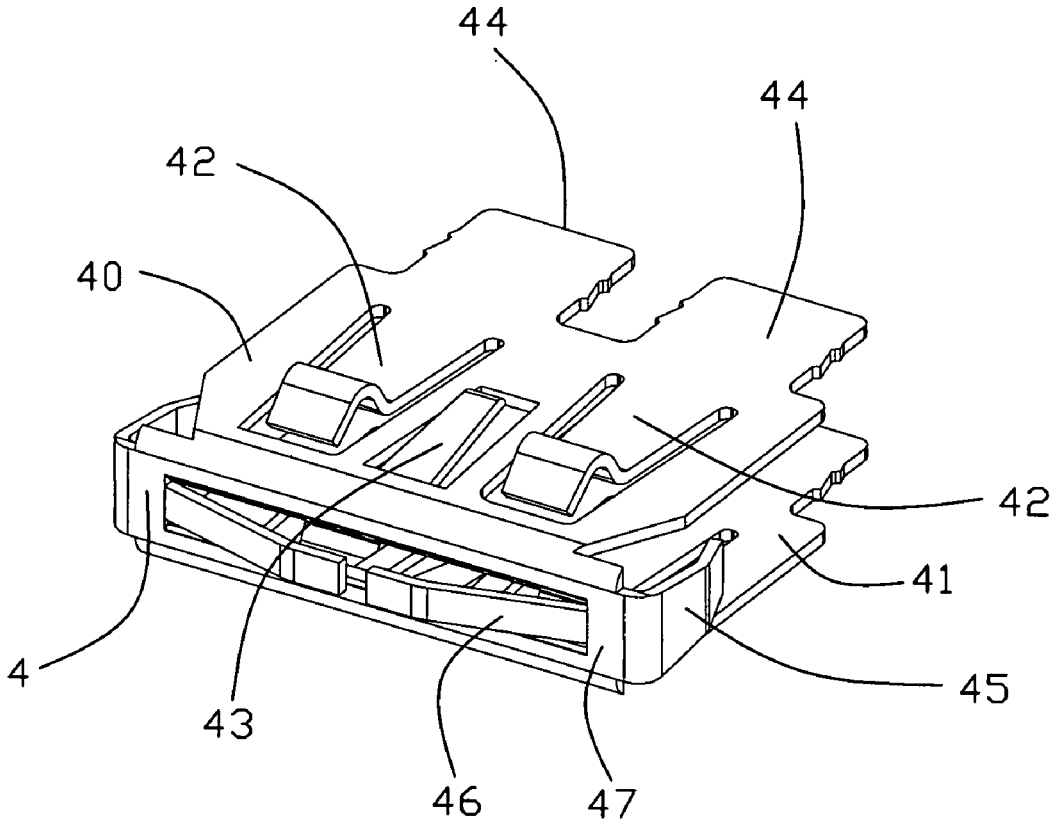
FIG. 4 is a perspective view of an inner shield of the electrical connector.

Referring to FIG. 4, the inner shield 4 is made of material with excellent mechanical property, and comprises a front wall 47, an upper wall 40 and a lower wall 41 extending rearwardly from two sides of the front wall 47. The front wall 47 is located at a front end of the partition plate 13. The upper wall 40 and the lower wall 41 are located at upper and lower sides of the partition plate 13. Each of the upper wall 40 and the lower wall 41 has a pair of spring arms 42 extending forwardly from a rear portion thereof and a resilient strip 43 extending rearwardly from a front portion thereof. A plurality of retention portions 44 extend rearwardly from each upper and lower walls 40, 41 for engaging with the dielectric housing 1. The inner shield 4 also comprises a pair of resilient grounding strips 46 extending forwardly from the front wall 47, and a pair of fastening tabs 45 extending rearwardly from two sides thereof for engaging with the outer shield 3.

The rear shield 5 comprises a plurality of locking tabs 52 engaging with the fastening holes 34 of the outer shield 3.

Referring to FIGS. 1-3, in assembly, firstly, the mounting holes 62 lock with the projections 32 of the outer shield 3 for fixing the resilient fingers 6 on the outer shield 3. The locking portion 64 extends through the opening 36 and into the contact area 15. It is obvious that the resilient fingers 6 are detachably mounted on the outer shield 3. The outer shield 3 is made of common iron sheet while the resilient fingers 6 are made of material with excellent mechanical property, such as stainless steel in order to provide longtime mating cycles while mating with corresponding plug. Iron is much cheaper than stainless steel, thereby, the cost of the electrical connectors 100 is decreased. Secondly, assembling the contacts 2 on the dielectric housing 1, the contact portions 21 extend to the tongue plates 12 of two contact areas 15. Thirdly, enclosing the dielectric housing 1 with the outer shield 3, the apertures 35 of the outer shield 3 engage with the protrusions 14 of the dielectric housing 1, the engaging arms 38 extending into the contact areas 15 simultaneously. Fourthly, installing the inner shield 4 on the partition plate 13, the retention portion 44 is inserted into the dielectric housing 1, the fastening tabs 45 engaging with the locking hole 33 for fastening the inner shield 4 on the dielectric housing 1 and the outer shield 3, the spring arms 42 and the resilient strips 43 extending into the contact areas 15. Finally, assembling the rear shield 5 to the outer shield 3, the locking tabs 52 engage with the fastening holes 34.

The outer shield 3, inner shield 4 and resilient fingers 6 are separately manufactured, therefore, they can be made of different materials.

Referring to FIGS. 1, 2 and 4, the corresponding plug 200 defines two pairs of openings 205 in upper and lower sides thereof. When the plug 200 is inserted into the electrical connector 100, the locking portions 64 of the resilient fingers 6 and the spring arms 42 of the inner shield 4 lock with the openings 205 respectively for fastening the plug 200 in a front to back direction. Since the inner shield 4 and the resilient fingers 6 are made of material with excellent mechanical property, the resilient strips 42 and the locking portions 64 can remain flexible adequate and engage with the plug 200 stably after longtime use. The resilient strips 43 abut against outer side of the plug 200 to prevent the plug 200 from moving along the up to down direction and to improve grounding effect between the plug 200 and the electrical connector 100. In addition, the engaging arms 38 of the outer shield 3 abut against two sides of the plug 200 for grounding.

Figure 5:
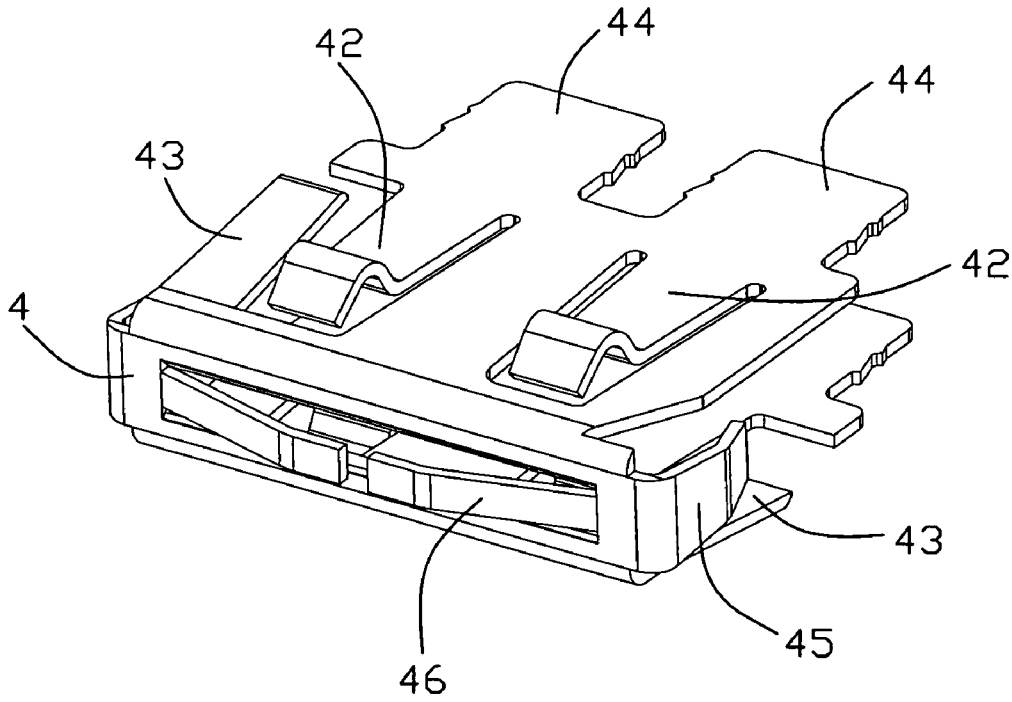
FIG. 5 is a perspective view of an inner shield of an electrical connector according to another embodiment of the present invention.

Referring to FIG. 5, in another embodiment of the present invention, the resilient strips 43 of the inner shield 4 are located at a outer side the spring arms 42, and also achieve a same effect as the first embodiment.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

a dielectric housing defining two contact areas along an up to down direction;

an outer shield enclosing the dielectric housing;

a plurality of contacts retained in the contact areas; and an inner shield retained between the two contact areas, the inner shield comprising at least a pair of spring arms to lock with a corresponding plug and a resilient strip extending into the contact areas to abutting against an outer side of the plug, wherein the resilient strip is located between the pair of the spring arms, wherein the resilient strip is located at a common side as the pair of the spring arms, wherein the spring arm extends forwardly from a rear portion of the inner shield, while the resilient strip extends rearwardly from a front portion of the inner shield, wherein the inner shield comprises an upper wall, a lower wall and an vertical front wall connecting with the upper wall and the lower wall, the pair of spring arms and the resilient strip are formed on both the upper wall and the lower wall, wherein the inner shield has a pair of resilient grounding strips extending forwardly from the front wall, wherein the inner shield has a pair of fastening tabs extending rearwardly from two sides thereof for engaging with the outer shield, wherein the inner shield has a plurality of retention portions extending rearwardly from a rear end of the upper wall and the lower wall respectively for locking with the dielectric housing, wherein the dielectric housing comprises a partition plate between two contact areas, the inner shield enclosing the partition plate, and, further comprising a plurality of resilient fingers detachably mounted on the outer shield, the outer shield defines a plurality of opening, each resilient finger having a locking portion extending into the contact area through the opening, wherein the outer shield has a plurality of projections, each resilient finger having a mounting hole engaging with the projection.

2. An electrical connector, comprising:

a dielectric housing having a partition plate to divide the dielectric housing into an upper portion and a lower portion;

an outer shield enclosing the dielectric housing to form two contact areas with the partition plate;

a plurality of contacts retained in the dielectric housing, each contact comprising a contact portion extending into the contact area; and an inner shield enclosing the partition plate, the inner shield having an upper wall and a lower wall located at the upper and lower sides of the partition plate, and each of the upper and lower wall having a pair of spring arms extending into the contact area for locking with a corresponding plug;

wherein each of the upper wall and the lower wall has a resilient strip extending into the contact area for abutting against the corresponding plug, the resilient strip extending along a direction opposite to the spring arm, wherein the resilient strip is located between the pair of spring arms, wherein the resilient strip is located at a common side as the spring arms, wherein the inner shield has a pair of resilient grounding strips extending forwardly from the front wall, wherein the inner shield has a pair of fastening tabs extending rearwardly from two sides thereof for engaging with the outer shield, wherein the inner shield has a plurality of retention portions extending rearwardly from a rear end of the upper wall and the lower wall respectively for locking with the dielectric housing.

3. An electrical connector comprising:

a dielectric housing defining upper and lower contact ports;

an outer shield enclosing the dielectric housing;

a plurality of contacts retained in the contact ports; and an inner shield retained between the two contact ports, the inner shield comprising essentially a lying U-shaped structure with opposite horizontal plates linked by a bight; wherein each of the horizontal plates is equipped with at least one spring arm extending into the corresponding mating port for locking, in both a front-to-back direction and a lateral direction, an outer shield of a complementary mated plug which is received in the corresponding mating port, and at least one resilient strip extending into the same corresponding mating port for mechanically and electrically engaging, in a vertical direction perpendicular to both said front-to-back direction and said transverse direction, the outer shield of the complementary mated plug, wherein the inner shell further includes a pair of fastening tabs at two opposite ends of the bight to latchably engage the outer shell, wherein the bight further includes a grounding strip extending forwardly for mechanically and electrically engaging a panel in front of the connector, through which the complementary mated connector extends.

* * * * *